US007779585B2

(12) United States Patent
Hester, Jr.

(10) Patent No.: US 7,779,585 B2
(45) Date of Patent: Aug. 24, 2010

(54) COMBINED SHOPPING CENTER AND APARTMENT BUILDING

(76) Inventor: Waitus C. Hester, Jr., 7147 Wilburdale Dr., Annandale, VA (US) 22003

( * ) Notice: Subject to any disclaimer, the term of this patent is extended or adjusted under 35 U.S.C. 154(b) by 1186 days.

(21) Appl. No.: 10/795,256

(22) Filed: Mar. 9, 2004

(65) Prior Publication Data

US 2005/0198919 A1 Sep. 15, 2005

(51) Int. Cl.
*E04H 1/00* (2006.01)
*E04H 1/02* (2006.01)
*E04H 3/10* (2006.01)

(52) U.S. Cl. ..... 52/236.3; 52/234; 52/174

(58) Field of Classification Search ..... 52/174, 52/175, 234, 79.3, 236.3, 79.1, 79.4, 64
See application file for complete search history.

(56) References Cited

U.S. PATENT DOCUMENTS

| | | | | | |
|---|---|---|---|---|---|
| 2,698,973 | A * | 1/1955 | Zeckendorf et. al. | ..... | 52/185 |
| 3,075,655 | A * | 1/1963 | Bryant | ..... | 414/264 |
| 3,290,837 | A * | 12/1966 | Weston | ..... | 52/30 |
| 3,603,047 | A * | 9/1971 | Tournier | ..... | 52/30 |
| RE27,341 | E * | 4/1972 | Graham | ..... | 52/175 |
| 3,839,833 | A * | 10/1974 | Steele | ..... | 52/90.1 |
| 3,874,137 | A * | 4/1975 | Gentry | ..... | 52/169.1 |
| 3,992,824 | A * | 11/1976 | Miller, Jr. | ..... | 52/29 |
| 4,154,027 | A * | 5/1979 | Searcy | ..... | 52/33 |
| 4,274,233 | A * | 6/1981 | Currier | ..... | 52/33 |
| 4,333,195 | A * | 6/1982 | Lichti | ..... | 14/71.5 |
| 4,928,452 | A * | 5/1990 | Sacks | ..... | 52/236.3 |
| 5,279,085 | A * | 1/1994 | DiPaolo et al. | ..... | 52/169.2 |
| 5,694,725 | A * | 12/1997 | Kaufman et al. | ..... | 52/236.3 |
| 5,941,034 | A * | 8/1999 | Frankfurt | ..... | 52/236.3 |
| 6,079,171 | A * | 6/2000 | Burke | ..... | 52/236.3 |
| 6,182,408 | B1 * | 2/2001 | Poehler | ..... | 52/234 |
| 6,279,855 | B1 * | 8/2001 | Domer | ..... | 244/114 R |
| 6,405,496 | B1 * | 6/2002 | Stewart et al. | ..... | 52/185 |
| 6,651,393 | B2 * | 11/2003 | Don et al. | ..... | 52/79.5 |
| 6,688,052 | B1 * | 2/2004 | Flanders | ..... | 52/169.3 |
| 6,862,853 | B1 * | 3/2005 | Visser | ..... | 52/234 |
| 6,925,761 | B1 * | 8/2005 | De La Marche | ..... | 52/79.7 |
| 2002/0095891 | A1 * | 7/2002 | Duany | ..... | 52/243 |

OTHER PUBLICATIONS

The Steinberg Collaborative, AIA, LLP, ARchitects and Planners, 1997, 3 pages.*
WWw.azcentral.com/home/hb101/articles/0809retailresidentia109-cp-html, pp. 1-3.*
WWW.kierlandcommons.com/about_us, p. 1-2.*
http://livinginurbansac.blogspot.com/2005/07/plaza-lofts.html.*

* cited by examiner

*Primary Examiner*—Phi Dieu Tran A
(74) *Attorney, Agent, or Firm*—Ronald E. Greigg

(57) ABSTRACT

A multistory building including a ground level shopping center and at least one upper story consisting of a plurality of apartment units constructed in side-by-side relation in laterally spaced rows, with an enclosed corridor extending completely around and separating the rows of apartment units. Front and rear doors lead from the individual apartment units to the adjacent corridor. Each apartment includes a patio between its rear door and the adjacent walkway area or corridor.

19 Claims, 4 Drawing Sheets

COMBINED SHOPPING CENTER AND APARTMENT BUILDING

BACKGROUND OF THE INVENTION

1. Field of the Invention

This invention relates to an improved combined shopping center and apartment building and more particularly to an improved multilevel building having at least one level of living units, or apartments, constructed integral with and above a shopping center, with access from each apartment to a system of common corridors sufficiently wide to permit easy use by people using wheelchairs, walkers or motorized carts, as well as by pedestrians on each living unit floor. Each apartment includes a patio space between its rear entrance and the adjacent common corridor, and the common corridor system is sufficiently wide to permit easy use by people using wheelchairs, walkers or motorized carts, as well as by pedestrians, provides a continuous passageway surrounding all apartments and extends on opposed sides of each individual apartment. In the preferred embodiment of this building structure, access is provided from the apartment levels directly to the shopping center level for safety and convenience of the apartment dwellers and to encourage their use of the shopping center facilities.

2. Description of the Prior Art

The continuous growth and demand for affordable dwellings, particularly in urban communities where available space for new building structures is limited and consequently very expensive, has resulted in an increase in the number of so-called high-rise, high density dwelling structures. Such high density structures enable economical land use, which in turn, provides more affordable living space, especially for low and middle income families.

The conventional high density apartment building typically consists of two rows of side-by-side apartments arranged in opposed relation one on each side of a common corridor on each floor. In this arrangement, the only exit from the individual apartment units is the single door leading into the single interior corridor. Further, the single interior corridor, typically extending between closed doors of the two rows of apartments, is not conducive to exercise walking, or in wheel chairs, motorized carts, or to socializing with neighbors on the same or other floors. The lack of natural lighting through windows simply does not encourage use of corridors for such purposes.

It is also known to provide dwelling structures consisting of a generally rectangular enclosure consisting of two rows of dwelling units such as apartments or rooms constructed in back-to-back relation, with a continuous open balcony or walkway extending around the enclosed structure to provide access to individual units. Such structures are commonly used in low rise units such as motels or the like. Again, only a single door is provided from the individual unit directly onto the balcony or walkway surrounding the floor.

U.S. Pat. No. 4,837,989 discloses a multilevel cylindrical building including a plurality of adjacent dwelling units on each aboveground level, with an open external balcony or walkway which may completely encircle the building. Radial passageways extend from the external walkway to internal stairways extending between floors and too internal commercial or other space. Occupants of any dwelling unit may walk along the external walkway to any radial location of the building and may use external or internal stairways to any floor of the building.

U.S. Pat. Nos. 6,405,496, 5,199,231 and 4,971,505, disclose multilevel building structures with a plurality of floors of dwelling units located above or adjacent to commercial space such as a shopping center, grocery store or the like. Each of these patents also discloses structure providing access from the dwelling units to the commercial floors. Again, however, these building structures are not configured to facilitate or encourage use of walkways, corridors or the like as exercise or socializing facilities, do not provide exits from opposite sides of the individual living units to a common corridor system, and do not provide enclosed patios between the living units and the common corridor system.

SUMMARY OF THE INVENTION

The disadvantages of the known multistory or high rise apartment structures discussed above are overcome in accordance with the present invention in which a multilevel building structure includes at least one upper level consisting of a plurality of individual dwelling units or apartments constructed integrally with and above a shopping complex. The dwelling units on each level are arranged in side-by-side relation in at least one group, with a continuous enclosed walkway system sufficiently wide to permit easy use by people using wheelchairs, walkers or motorized carts, as well as by pedestrians and extending completely around each such group on each level. Each dwelling unit is provided with front and rear doors each leading to the walkway system, thereby providing enhanced safety and convenience. The walkway extends completely around the periphery of the building on each dwelling level, with windows or curtain wall structure on the external wall of the building providing a panoramic view from each floor and admitting natural light.

Each dwelling unit includes a patio area located between the rear entrance to the apartment and the adjacent enclosed walkway whereby apartment dwellers sitting in the patio area can socialize with residents who pass along the common walkway. If desired, the patio area may be at least partially separated from the walkway by a railing, partial wall, or the like. Each common walkway is sufficiently wide to permit easy use by people using wheelchairs, walkers or motorized carts, as well as by pedestrians.

The building structure includes a shopping center occupying at least the ground level, with the apartment levels constructed integrally with and above the shopping center. As used herein, the term "shopping center" is intended to include both a conventional multi-store shopping center as well as large grocery stores, drug stores, or the like. This arrangement provides economical use of available land areas by constructing apartment units in the air rights over the shopping area, and provides easy access to shopping by the apartment dwellers. This is particularly important in such buildings where a portion of the occupants may be elderly or handicapped, or who do not have ready access to transportation. Also, by providing elevators or other access means between the living space and the shopping center, security and convenience for the apartment dwellers are enhanced, and the use of the shopping center facilities is encouraged.

By constructing the apartment levels above a conventional single story or low-rise shopping facility, substantial savings are realized, particularly in high density areas where land is scarce and very expensive. Since the space above such shopping centers is normally not utilized, more space can be economically devoted to enhancing the livability of the dwelling levels by providing a more expansive system of corridors, or walkways, and by providing patio space for each apartment to promote exercise, whether walking, in a wheel chair, a walker, or a motorized cart and socialization by the apartment dwellers.

BRIEF DESCRIPTION OF THE DRAWINGS

The foregoing and other features and advantages of the inventions will be apparent from the detailed description contained herein below, taken into consideration with the drawings, in which.

DESCRIPTION OF THE PREFERRED EMBODIMENTS

Figure 1:
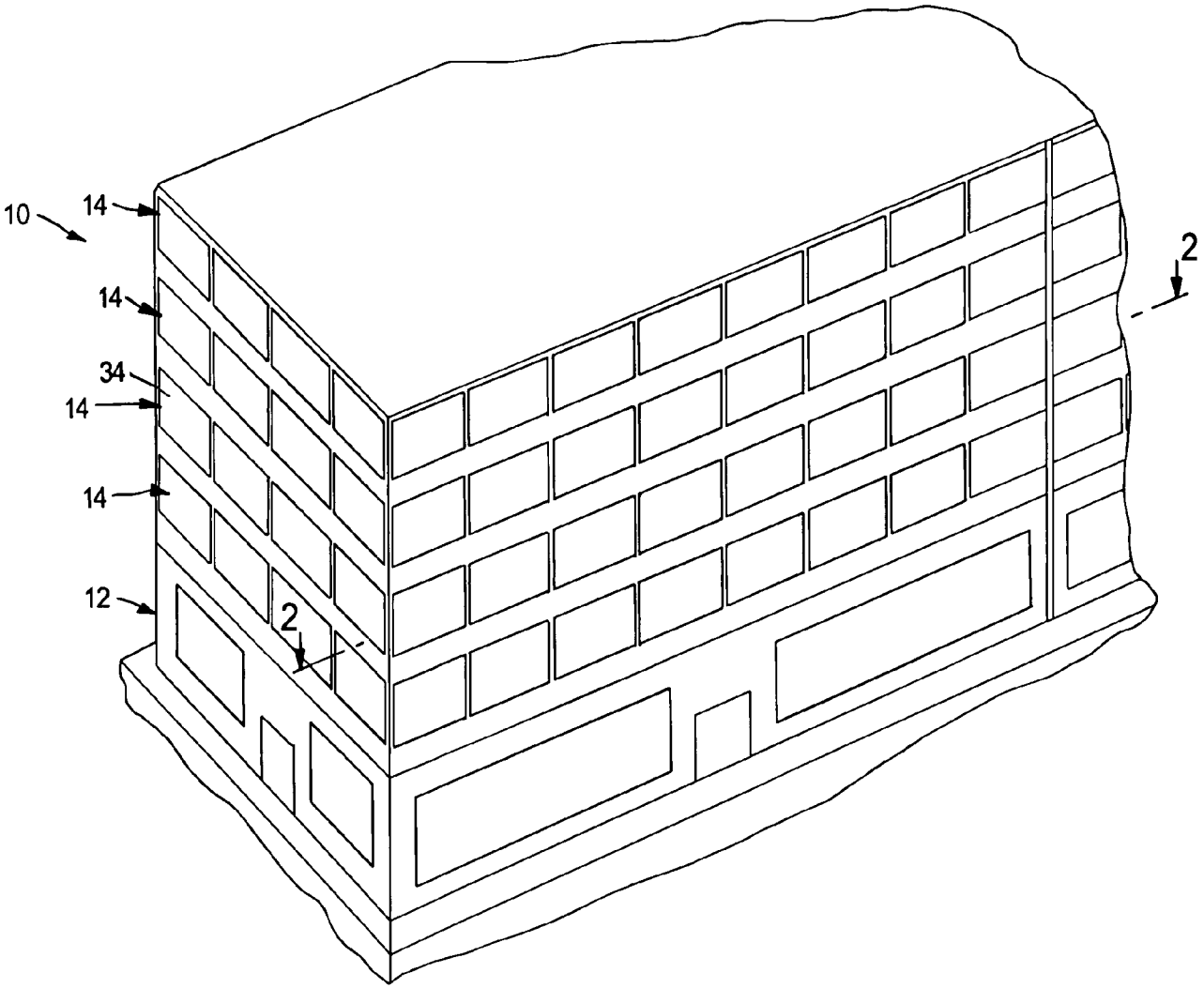
FIG. 1 is a fragmentary perspective view of a building structure embodying the invention.

Referring now to the drawings in detail, a building structure incorporating the present invention is indicated generally in FIG. 1 by the reference numeral 10, and is defined by external walls 11. The building 10 includes a first or ground floor level 12 incorporating commercial space such as a large grocery store, drug store, or the like, or preferably a larger structure such as a conventional shopping mall, and a plurality of dwelling floors 14 constructed integrally with and above the ground floor. The floor plan of the shopping center is irrelevant to the floor plan of the dwelling floors 14, although it is pointed out that the ground floor may have an external configuration substantially identical to the upper levels 14 as shown in FIG. 1.

Figure 2:
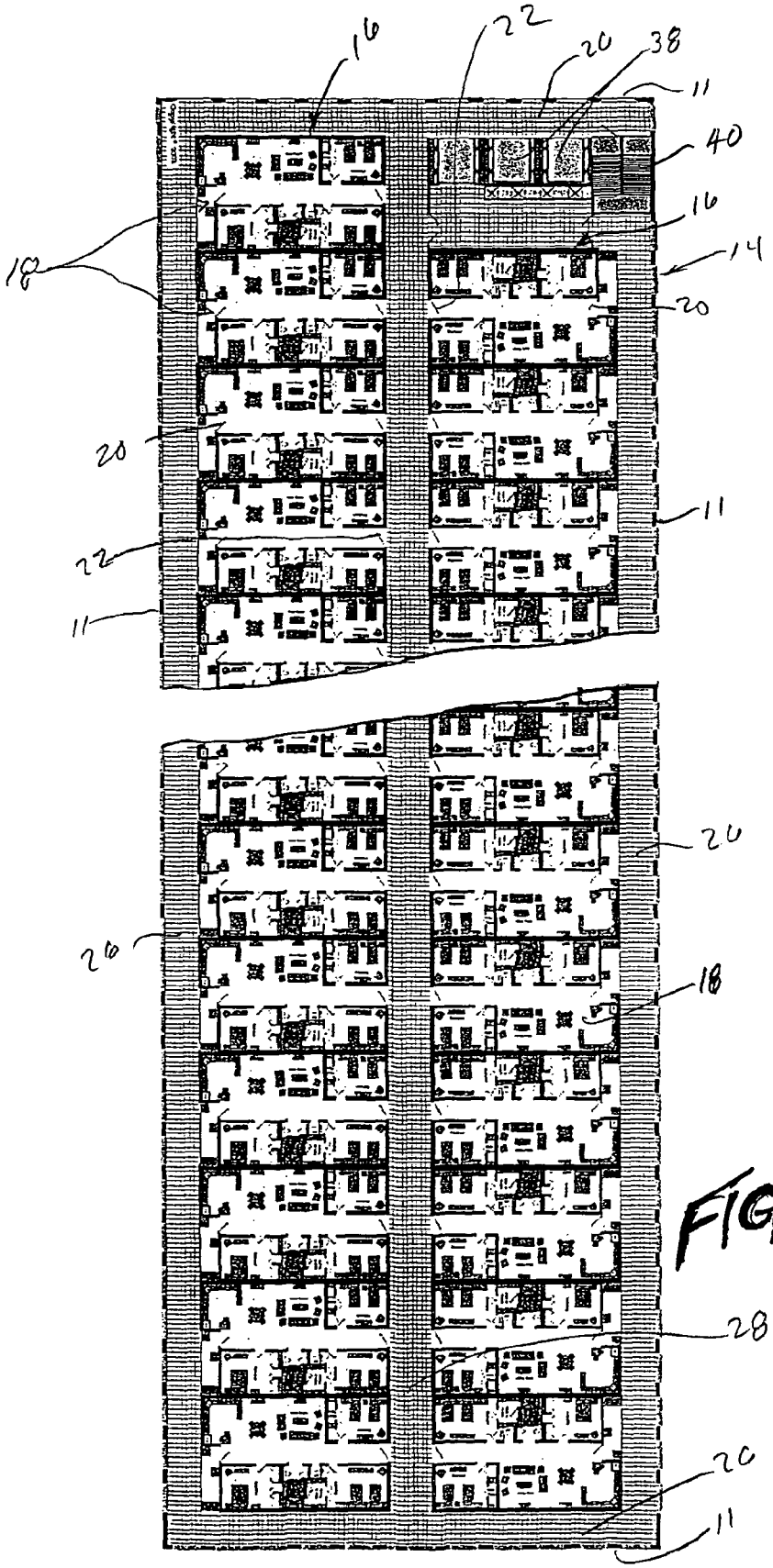
FIG. 2 is a fragmentary plan view showing a typical floor plan of an upper level of the building shown in FIG. 1.

As shown in the floor plan of FIG. 2, the individual dwelling floors 14 each preferably comprise at least two laterally spaced, generally parallel rows 16 of dwelling units, or apartments 18, with each row consisting of a plurality of individual apartments in side-by-side relation and each having front and rear entrances or doors 20, 22 opening from the apartment units 18 to a common enclosed walkway system 24 which is sufficiently wide to permit easy use by people using wheelchairs, walkers or motorized carts, as well as by pedestrians and includes an external loop 26, extending completely around each dwelling floor 14 and one or more connecting walkway segment 28.

In the embodiment shown in FIG. 2, each apartment unit 18 may have a rear door 20 opening to the peripheral walkway segment 26 and a front door 22 opening to an interior walkway segment 28. In the embodiment shown in FIG. 3, the apartment units may be arranged in three or more rows including two rows in which each apartment unit has a rear door 20 opening into a walking segment 26 towards an outside wall 11 of the building and a back door opening into a connecting walkway segment 28, and an internal row in which the apartment doors each open into an internal walkway segment 28. The rows 16 of apartments may also be divided by transverse walkway segments 28.

Figure 4:
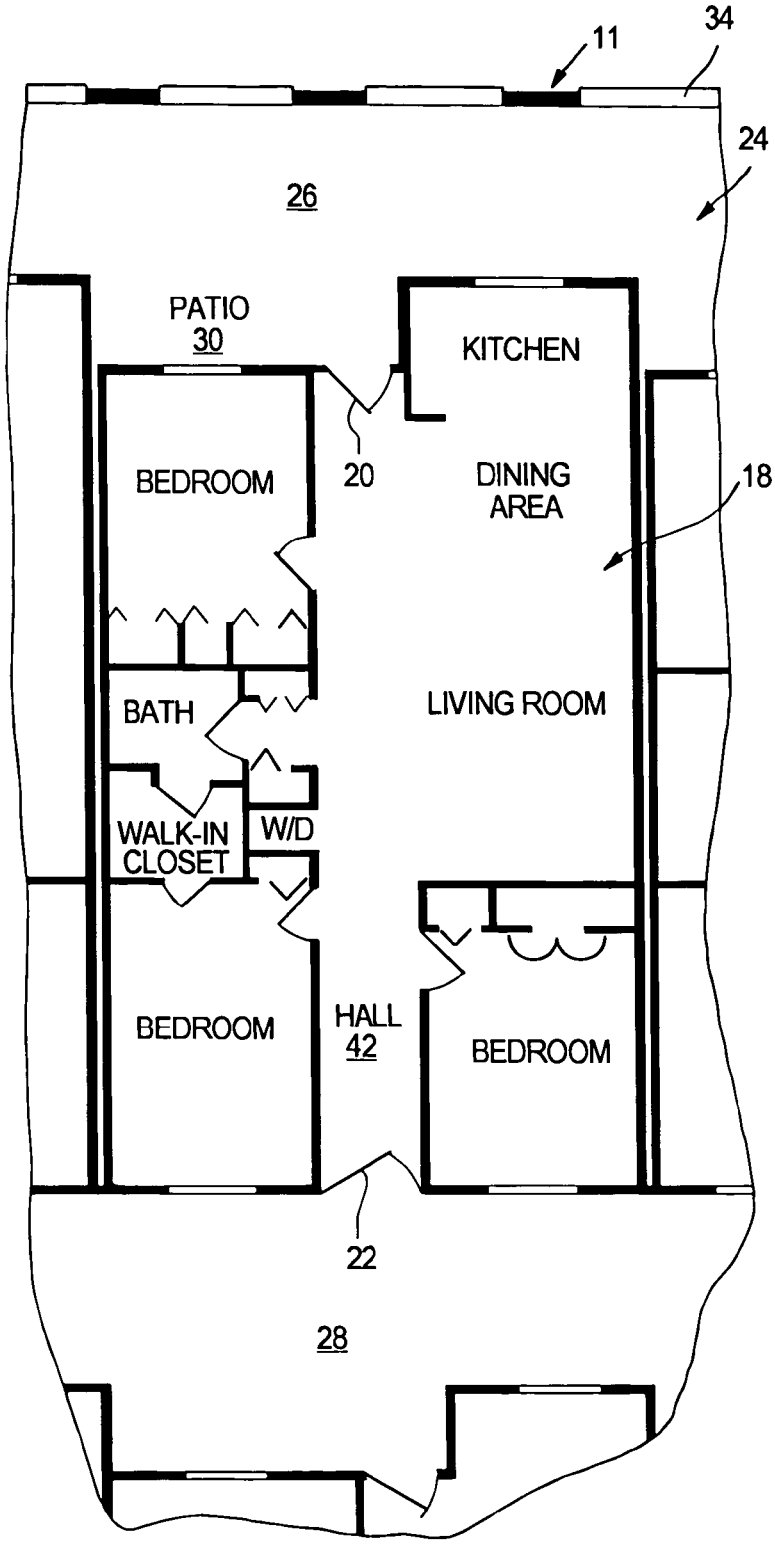
FIG. 4 is an enlarged floor plan of an individual apartment unit and the adjacent corridor space.

As seen in FIG. 4, each apartment unit 18 includes a patio area 30 between the rear door 20 and the adjacent segment of walkway system 24. Also, the external wall 11 of the building 10 is preferably provided with large windows 34, or transparent curtain wall panels to provide a panoramic view from the external walkway segment 26 to the exterior of the building and to permit natural light and/or sun to light the walkway and patio during daylight hours. The windows 34 also provide an external view from the patios 30 which face an external walkway segment 26.

The walkway system 24, including the external segment 26 and connecting internal segments 28 is preferably substantially unobstructed although fire doors or the like may be provided where required or deemed necessary. The walkway system 24 is enclosed, that is, it is surrounded on all sides by a solid wall from floor to ceiling, and of sufficient width to enable easy use thereof by wheelchair occupants, motorized carts and persons using walkers, as well as by pedestrians for recreational or exercise walking. The juxta-position of the internal enclosed patios 30 and the adjacent walkways promotes socializing between persons sitting on their private patio and persons using the walkways, thereby promoting a more friendly, community atmosphere between the occupants of the apartments on their respective floors. The large expanse of glass in the internal walls 11 gives the feel of open or outdoor space, thereby encouraging walking both for exercise and for recreation or socializing with neighbors.

Figure 3:
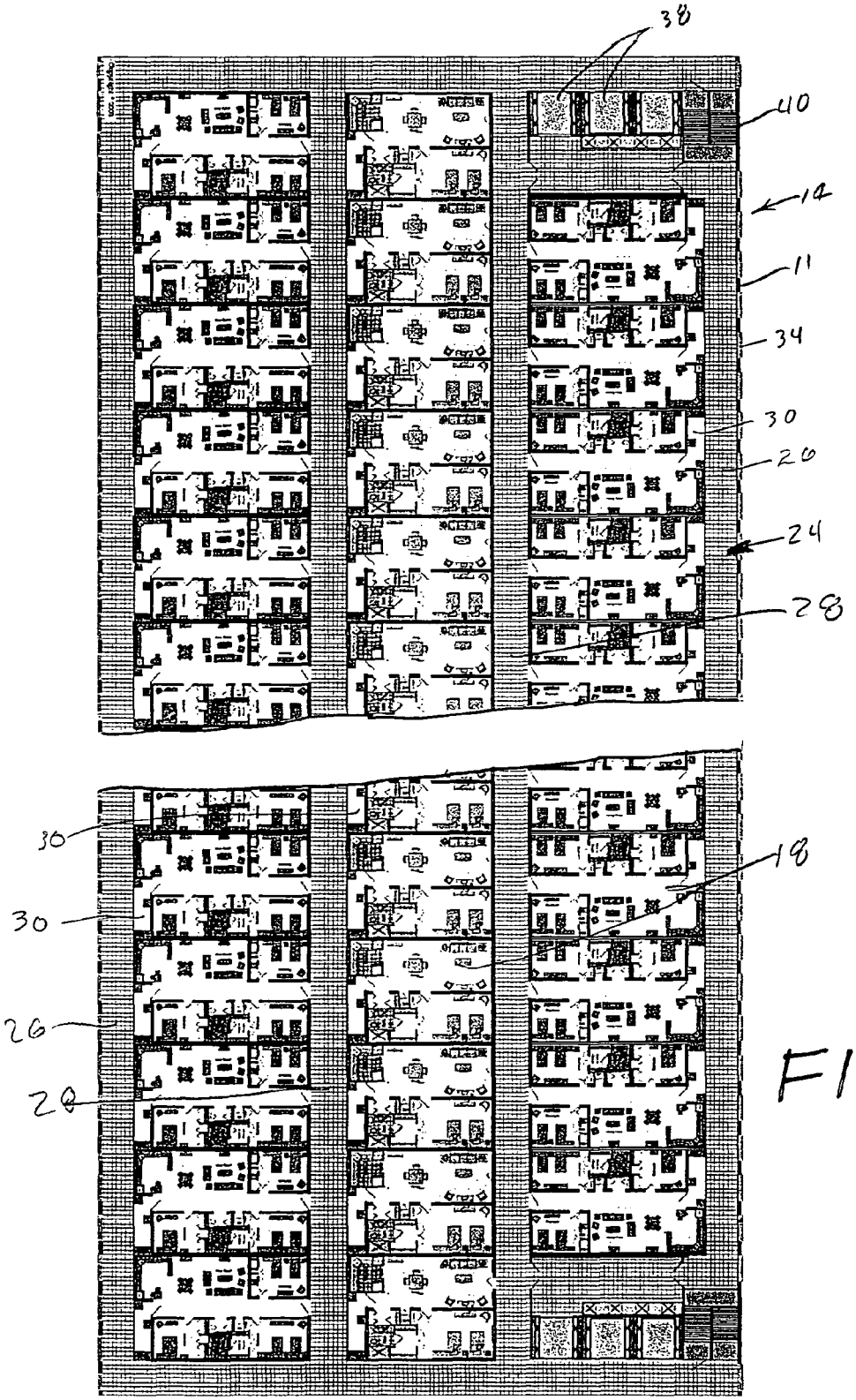
FIG. 3 is a view similar to FIG. 2 showing an alternative floor plan.

Also as shown in FIGS. 2 and 3, access to the respective dwelling levels is provided by suitable means such as the elevators 38 and/or stairwells 40. The elevators and/or stairwells preferably extend to a lobby or connecting area in the shopping center which, in turn, provides access to the commercial space without leaving the comfort and safety of the building enclosure. Controlled access to the apartment levels from the connecting area is provided.

The size and the floor plan of the individual apartment units are not relevant to the invention and may vary. For example, the front door of the individual apartments may lead from the interior walkway segment 28 to a short hallway or corridor 42 inside the apartment as shown in FIG. 4, or if desired may open directly into a room such as a den or bedroom. The important element is the dual entrance-exit afforded by the front and rear doors, both for convenience and safety. Particularly when the apartment units are occupied by elderly or handicapped persons, quick and easy access to an exit could be crucial.

The size and location of the patios 30 adjacent each apartment may also be varied depending upon the apartment floor plan and space available. The patios provide an open-space feeling and promote the enjoyment of natural lighting as well as a view from the building. By providing the patios adjacent to but offset from the walkway system, the feeling of private yet open space is afforded and socialization with persons using the walking system is encouraged.

FIG. 4 shows a typical floor plan for an apartment 30 and its relation to the enclosed common corridor system. In this floor plan, the front door 22 leads into a large room serving as a combination kitchen, dining area and living room. Three bedrooms are illustrated, each including one or more closets. A single bathroom is illustrated, along with space for a stacked washer-dryer (w/d), and additional closet space is shown between the bathroom and the living room area. It is understood, of course, that the size and floor plan of the individual apartments may be varied, and in FIG. 3, the interior rows of apartments are illustrated as being one bedroom units.

The advantages obtained by constructing the dwelling units above commercial space such as shopping centers, grocery stores, or the like, which are normally constructed as single level building structures, enables more economical land use particularly in urban areas where available land is scarce and very expensive. Thus, a reduced capital cost is realized which enables a substantial savings in the form of lower rent to the individual apartment dweller. This may be particularly advantageous in providing affordable housing for low income people as well as for the elderly and/or handicapped. The convenience and safety afforded by the shopping center in the building is also of particular advantage to the elderly and handicapped.

The combination of the commercial space with upper level residential space also provides advantages for the commercial establishments that provide convenient shopping facilities to the residences. The residents in the upper levels provide a steady, reliable customer base for the commercial establishments as well as a source of potential employees.

The dwelling floors, or at least a portion of them, may be modified by providing other common areas such as meeting rooms for resident assemblies, arts and crafts, or the like.

While preferred embodiments of the invention have been disclosed and described, it should be apparent that the building design and structure is not solely limited thereto, but rather it is therefore intended to include all embodiments of the invention which would be apparent to one skilled in the art and which come within the spirit and scope of the invention.

I claim:

1. A combined shopping center and apartment complex for the elderly and the elderly with handicaps in the form of a multistory building structure including shopping facilities on a ground level and at least one dwelling story located on an upper level of the building, each dwelling story comprising:

at least two laterally spaced, generally parallel rows of dwelling units each consisting of a plurality of individual dwelling units joined in side-by-side relation, a continuous enclosed walkway system sufficiently wide to permit easy use by people using wheelchairs, walkers or motorized carts, as well as by pedestrians and extending around and separating said at least two dwelling unit rows on each said dwelling level, said enclosed walkway system being surrounded on all sides by a solid wall from floor to ceiling, and access door means leading to said enclosed walkway system on opposed sides of each dwelling unit, wherein the walkway includes an exterior portion extending around the outer peripheral wall of each dwelling story, said exterior portion of the walkway having one wall defined by the building exterior wall extending substantially around the entire building and including windows providing a view from the walkway to the exterior of the building.

2. A multistory building structure as defined in claim 1, wherein the walkway system includes an interior portion extending between adjacent rows of dwelling units.

3. The multistory building structure as defined in claim 1, further comprising interior access means leading from said dwelling stories to said shopping facilities.

4. The multistory building structure as defined in claim 3, wherein said interior access means comprises elevators.

5. The multistory building structure as defined in claim 3, wherein said interior access means comprises stairwells.

6. The multistory building structure defined in claim 1, wherein each dwelling unit comprises a patio area disposed between one access door and an adjacent portion of the continuous enclosed walkway.

7. The multistory building structure as defined in claim 6, further comprising divider means separating said patio area and the adjacent walkway, said divider means being at least partially open.

8. The multistory building structure defined in claim 7, wherein said patio area is located between one door means and the portion of the said walkway extending around the peripheral wall of said building.

9. A multistory building structure as defined in claim 8, wherein the walkway system includes an interior portion extending between adjacent rows of dwelling units.

10. The multistory building structure as defined in claim 2, further comprising interior access means leading from said dwelling stories to said shopping facilities.

11. The multistory building structure as defined in claim 10, wherein said interior access means comprises elevators.

12. The multistory building structure as defined in claim 10, wherein said internal access means stairwells.

13. A multistory building structure as defined in claim 1, wherein each of the individual dwelling units includes, within the walls of the dwelling unit, at least one bedroom area, cooking facilities and a bathroom.

14. A multistory building structure including a lower story shopping center and at least one dwelling story located on an upper level of the building, each dwelling story comprising at least one group of dwelling units arranged in side-by-side relation in a row, enclosed walkway means extending completely around each said row of dwelling units, said enclosed walkway means being surrounded on all sides by a solid wall from floor to ceiling, access door means leading to a continuous walkway on opposed sides of each said dwelling unit, and each said dwelling unit including a patio area located in a recess in an outer peripheral wall of each said dwelling unit adjacent the continuous walkway.

15. A multistory building structure as defined in claim 14, wherein the walkway includes an exterior portion extending around the outer peripheral wall of each dwelling story, said exterior portion having one wall defined by the building exterior wall, said exterior portion of the walkway extending substantially around the entire building and including windows providing a view from the walkway to the exterior of the building substantially around the entire building periphery.

16. The multistory building structure defined in claim 15, wherein said patio area is located between one door means and the portion of the said walkway extending around the peripheral wall of said building.

17. The multistory building structure as defined in claim 14, further comprising interior access means leading from said dwelling stories to said lower story shopping center.

18. The multistory building structure as defined in claim 17, wherein said interior access means comprises elevators.

19. A multistory building structure as defined in claim 14, wherein each of the dwelling units includes, within the walls of the dwelling unit, at least one bedroom area, cooking facilities and a bathroom.

* * * * *